United States Patent [19]

Shewchuk

[11] Patent Number: 4,537,377

[45] Date of Patent: Aug. 27, 1985

[54] BAG HOLDER

[76] Inventor: W. Donald Shewchuk, 170 Commander Blvd., Agincourt, Ontario, Canada, M1S 3C8

[21] Appl. No.: 676,572

[22] Filed: Nov. 30, 1984

[30] Foreign Application Priority Data

Oct. 26, 1984 [CA] Canada ..... 466462

[51] Int. Cl.[3] ..... B65B 67/04

[52] U.S. Cl. ..... 248/99

[58] Field of Search ..... 248/95, 97–101, 248/459

[56] References Cited

U.S. PATENT DOCUMENTS

| | | | |
|---|---|---|---|
| 2,099,924 | 11/1937 | Bressler | 248/97 |
| 2,789,781 | 4/1957 | Miller | 248/101 |
| 3,388,882 | 6/1968 | Burroughs | 248/97 |
| 3,687,408 | 8/1972 | Lake | 248/97 |
| 3,802,620 | 4/1974 | Ferrara | 248/99 |
| 4,044,980 | 8/1977 | Cummins | 248/676 |
| 4,291,798 | 9/1981 | Transport | 248/459 |

*Primary Examiner*—Reinaldo P. Machado
*Assistant Examiner*—Alvin Chin-Shue
*Attorney, Agent, or Firm*—Balogh, Osann, Kramer, Dvorak, Genova & Traub

[57] ABSTRACT

A bag holder molded integrally from plastic material for holding plastic shopping bags having handle openings is disclosed. The holder has front and rear frame members of inverted U-shape which are pivotally interconnected by plastic hinge webs which enable the opening and closing of the frames. The handle openings of a bag are positioned over upstanding flanges provided on the front and rear frames and interconnected links which are molded integrally with the frames limit the extent of opening of the frame members. Also disclosed is additional bag securing means consisting of integrally molded flexible straps which carry bag securing buttons which are snugly received within circular openings provided in the frames to clamp a bag to the holder. The holder enables the convenient hanging of plastic shopping bags for use as garbage and refuse bags.

6 Claims, 5 Drawing Figures

BAG HOLDER

The present invention relates to a bag holder and particularly to a holder for plastic bags for receiving garbage and other refuse.

More specifically, the present invention relates to a holder for bags which is economic in manufacture and which is integrally molded of plastic material and which provides means for suspending plastic shopping bags having handle openings of the type which are currently in use by food and other stores and which enables such bags to be conveniently and usefully utilized for the disposal of garbage and other refuse.

While the holder of the invention is particularly useful for holding and suspending plastic bags having handle openings, the holder can also, if desired, be used to support bags of other material such as paper and which may, or may not, be provided with handle openings or loops.

The integrally molded bag holder according to the present invention consists of front and rear frame members which are each of inverted U-shape and which are interconnected at the ends of their arms by hinges formed of webs of plastic material which permit relative movement of the frame members from closed contacting position to open position. The assembly includes means to removably secure the frame members in closed contacting position and means are provided on the front and rear frame members to hold a shopping, garbage, or refuse bag. Links are molded integrally with the front and rear frame members to limit the extent of opening of the holder. One end of each link is pivotally secured to its respective frame member by a plastic hinge web, and the free ends of the links on the rear frame member are pivotally interconnected with the free ends of respective links on the front frame member and this articulated linkage limits the extent to which the front frame member can be pivotally moved forwardly from the rear frame member.

The rear frame member is provided with an upstanding flange and the front frame member is provided with an upstanding handle flange, and these flanges together provide means for both removably holding the frame members together to close a bag supported thereby and also to provide means for securing a bag having handle openings to the holder.

In an embodiment, the frame members are provided with additional bag securing means to enable the holder to hold and suspend plastic bags which do not have handle openings, or to more securely hold bag having handle openings on the frame members. These additional bag securing means consist of flexible straps of plastic material molded integrally with the frame member and which carry bag securing buttons which are adapted to be snugly received within adjacently positioned circular openings provided in the frames. One side of a bag which is to be secured to the holder is simply positioned over the circular openings and the securing buttons snugly positioned therein to clamp the bag with respect to the frames.

BRIEF DESCRIPTION OF ACCOMPANYING DRAWINGS

DETAILED DESCRIPTION OF ACCOMPANYING DRAWINGS

Figure 1:
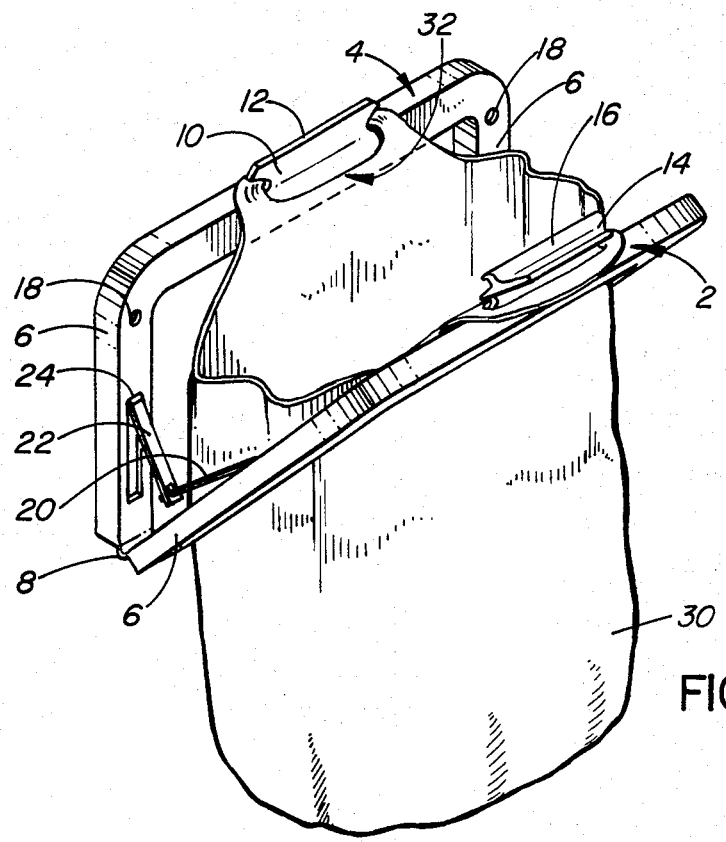
FIG. 1 illustrates in perspective view the holder of the present invention in open position and showing a plastic bag supported thereby.

The present invention will now be described in more detail with reference to the accompanying drawings wherein like reference numerals refer to like parts.

Figure 2:
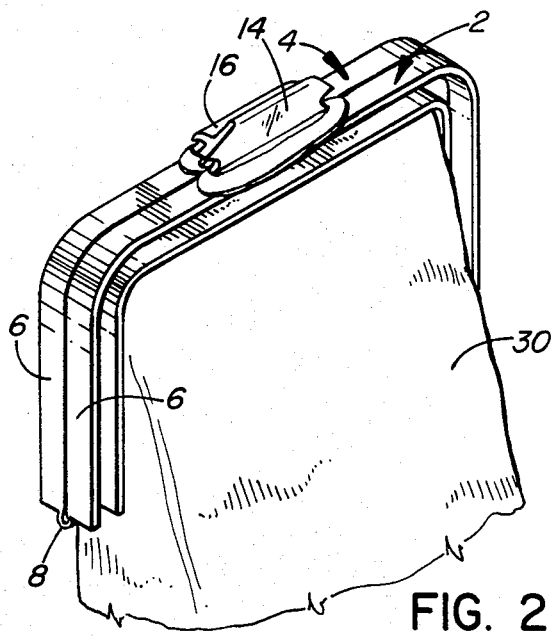
FIG. 2 illustrates in perspective view the present bag holder in closed position.
Figure 3:
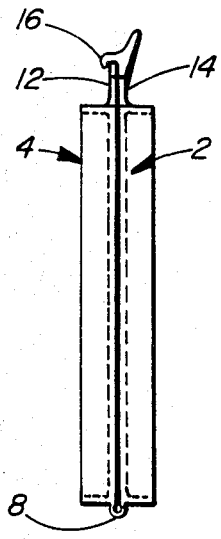
FIG. 3 illustrates, in side view, the present bag holder in closed position.

With reference to FIGS. 1, 2 and 3, the holder consists of a front frame member 2 of U-shaped configuration and a rear frame member 4 of similar shape which are pivotally joined at the ends of their arms 6 to enable relative movement between the front and rear frame members to and from the open position shown in FIG. 1 and the closed position shown in FIGS. 2 and 3.

The front and rear frame members are of plastic material which are integrally molded and are joined by relatively thin webs 8 of plastic material to form what has become known as living hinges. Polypropylene is a suitable plastic material for use in the manufacture of the present holder although other plastic materials could be used bearing in mind the durability requirements of a living hinge.

Figure 4:
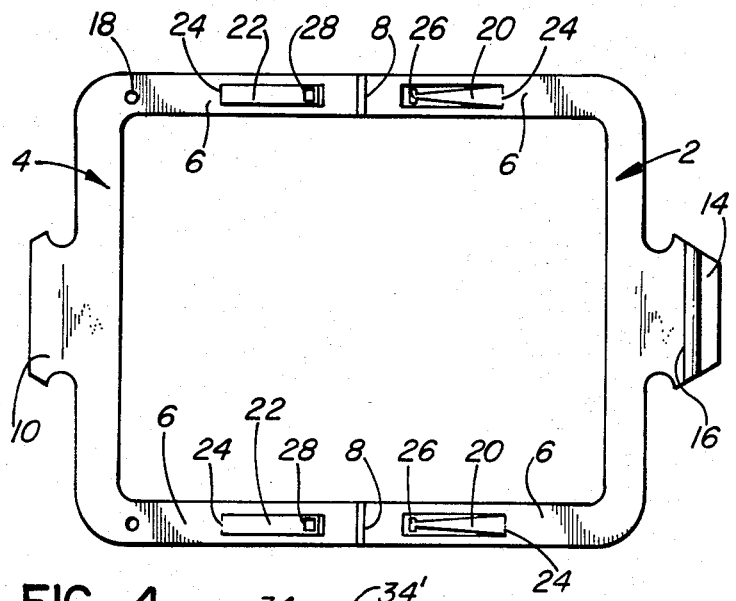
FIG. 4 illustrates the bag holder of FIGS. 1, 2, and 3 in top view and showing the integral formation of the present bag holder by plastic molding.

The front and rear frame members are preferably molded in a flattened arrangement as shown in FIG. 4 and thereafter are relatively pivoted along the plastic hinge webs 8 to provide the frame arrangement as shown in FIGS. 1, 2 and 3.

The rear frame member 4 is provided with an integrally molded upstanding flange 10 having an upper edge 12, and the front frame member 2 has an integrally molded upstanding handle 14 which has an inwardly and downwardly angled lip 16 which when the frames are closed together as shown in FIGS. 2 and 3 engages over the edge 12 of flange 10 on the rear frame member to secure the frame sections together and close the bag as shown in FIGS. 2 and 3.

To position the bag holder conveniently on a cupboard door or other suitable vertical support (not shown) openings 18 are provided for screws or other securing means.

The extent of opening of the frame members to the position shown in FIG. 1 wherein the bag is in open position is limited by links 20 and 22 formed integrally with the front and rear frame members 2 and 4, respectively, and which interlock at their free ends as shown to limit the amount of opening of the frames.

During molding of the holder and as shown in FIG. 4, the links 20 and 22 are molded integrally with respect to their related frame members and are connected thereto by hinge webs 24 of plastic material which permit pivoting movement of the links with respect to their supporting frame members.

The links 20 taper inwardly toward their free ends where they are provided with enlarged ends 26, and the free ends of links 22 are provided with openings 28 which in width are somewhat smaller than the width of the enlarged ends 26 of links 20. The diagonal lengths of the opening 28 are, however, generally equal to the width of the ends 26 and when the molded assembly is removed from the mold, the frame members are folded toward each other and the enlarged portions 26 on links 20 are slipped into the openings 28 on links 22 by simply relatively twisting the links and slipping the enlarged portions 26 into the openings 28 to interlock the links in the manner as shown in FIG. 1. This is possible due to the resilient/flexible nature of the plastic material and the relative sizes of the link ends and link openings. Once interlocked, however, the link components will remain so during normal usage and will act to limit the extent of opening of the frame members.

In addition to acting as means for securing the frame members together the upstanding flange 10 on the rear frame and the upstanding handle 14 on the front frame also serve as means to secure a shopping bag 30 having handle openings 32 to the frames as shown in FIG. 1. This arrangement enables plastic shopping bags having handle openings which are commonly in use by various stores to be conveniently hung to serve as garbage bags or bags for other refuse.

Figure 5:
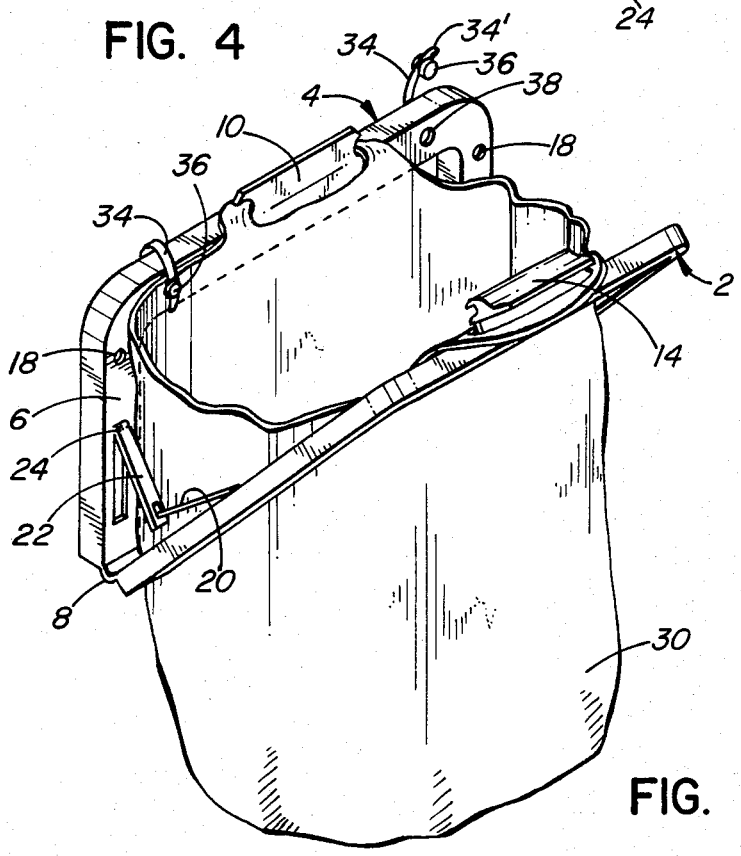
FIG. 5 illustrates in perspective view an embodiment of the present bag holder in open position and showing the provision of additional bag securing means.

FIG. 5 illustrates in perspective view an embodiment of the present bag holder having additional means to more positively secure a plastic bag to the bag holder. These securing means are in the form of flexible straps 34 having locking buttons 36 which are also of plastic material and which straps and buttons are integrally molded with the frame members during the formation of the assembly.

The locking buttons 36 are of a size to be snugly received within circular openings 38 provided in a front surface of the frame member 4 forwardly adjacent to the straps 34, and the buttons may preferably be of conical shape to enable a secure wedging within the openings 38.

In use and as shown to the left in FIG. 5, a layer of bag material is simply laid over the circular openings 38 and the locking button 36 of the adjacent strap 34 is then simply pushed snugly into the opening to secure the bag in position. Conveniently the locking buttons are positioned a distance inwardly from the ends of the straps as shown so that the ends 34' of the straps provide tabs for the ease of removal of the buttons from the openings when a bag is to be removed from the holder.

While the bag 30 shown in FIG. 5 does have handle openings it will be appreciated that a plastic bag without handle openings can be securely fastened to the frame 4 by simply using the two locking button arrangements. Also, and while FIG. 5 shows the locking straps and related button openings as being provided only on the rear frame member 4, it will be appreciated that a similar bag securing arrangement could also be used on the front frame member 2 to hold a bag in position.

I claim:

1. A holder for garbage and refuse bags integrally molded of plastic material comprising front and rear frame members each of inverted U-shape interconnected at the ends of their arms by hinges formed of webs of plastic material permitting relative movement of the frame members from closed contacting position to open position, and having means to secure the frame members in closed contacting position, and and means on the front and rear frame members to hold a shopping, garbage or refuse bag, and links molded integrally with the front and rear frame members, one end of each link being pivotally secured to its respective frame member by a plastic hinge web, with the free ends of the links on the rear frame member being pivotally interconnected with the free ends of respective links on the front frame member to limit the opening of the frame members.

2. A holder according to claim 1, wherein the rear frame member has an upstanding flange and the front frame member has an upstanding handle flange, the upstanding flange engaging within handle openings in plastic shopping bags to secure the bags to the holder and extend downwardly therefrom.

3. A holder according to claim 2, wherein the handle flange on the front frame member is provided with an inwardly and downwardly extending lip to engage over the top edge of the upstanding flange on the rear frame member to removably secure the frame members together in closed contacting position.

4. A holder according to claim 1, wherein an upper surface of the rear frame member is provided with two or more flexible straps of plastic material molded integrally therewith, with each flexible strap having an integrally molded bag securing button of a size to be snugly and removably received within a circular opening provided in an adjacent surface of the rear frame member, material of a bag to be held by the holder being positioned over the circular openings and the respective bag securing buttons then engaged into their respective openings to secure the bag to the holder.

5. A holder according to claim 4 wherein the bag securing buttons are of conical shape for snug reception within their respective circular openings.

6. A holder according to claim 4, wherein the front frame member is also provided with said flexible straps, buttons, and circular openings to secure a forward portion of the bag thereto.

* * * * *